US008287664B2

(12) United States Patent
Brunner

(10) Patent No.: US 8,287,664 B2
(45) Date of Patent: Oct. 16, 2012

(54) METHOD FOR THE PRODUCTION OF MAGNET CORES, MAGNET CORE AND INDUCTIVE COMPONENT WITH A MAGNET CORE

(75) Inventor: Markus Brunner, Bessenbach (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 689 days.

(21) Appl. No.: 12/308,753

(22) PCT Filed: Jul. 11, 2007

(86) PCT No.: PCT/IB2007/052771

§ 371 (c)(1),
(2), (4) Date: Apr. 10, 2009

(87) PCT Pub. No.: WO2008/007345

PCT Pub. Date: Jan. 17, 2008

(65) Prior Publication Data

US 2011/0056588 A9 Mar. 10, 2011

Related U.S. Application Data

(60) Provisional application No. 60/820,222, filed on Jul. 24, 2006.

(30) Foreign Application Priority Data

Jul. 12, 2006 (DE) ..... 10 2006 032 520

(51) Int. Cl.
*H01F 1/22* (2006.01)

(52) U.S. Cl. ..... 148/306; 148/304; 148/307; 148/104

(58) Field of Classification Search ..... None
See application file for complete search history.

(56) References Cited

U.S. PATENT DOCUMENTS

| | | | |
|---|---|---|---|
| 3,255,512 | A | 6/1966 | Lochner et al. |
| 4,076,861 | A | 2/1978 | Furukawa et al. |
| 4,201,837 | A | 5/1980 | Lupinski |
| 4,472,334 | A | 9/1984 | Gallimard |
| 4,543,208 | A | 9/1985 | Horie et al. |
| 4,601,765 | A | 7/1986 | Soileau et al. |
| 4,743,311 | A | 5/1988 | Schultz et al. |
| 4,891,079 | A | 1/1990 | Nakajima et al. |
| 4,923,533 | A | 5/1990 | Shigeta et al. |
| 4,985,089 | A | 1/1991 | Yoshizawa et al. |
| 5,160,379 | A | 11/1992 | Yoshizawa et al. |
| 5,252,148 | A | 10/1993 | Shigeta et al. |
| 5,258,473 | A | 11/1993 | Niessner et al. |
| 5,509,975 | A | 4/1996 | Kojima et al. |
| 5,522,948 | A | 6/1996 | Sawa et al. |
| 5,594,397 | A | 1/1997 | Uchikoba et al. |
| 5,751,207 | A | 5/1998 | Poess |
| 5,762,967 | A | 6/1998 | Sagawa et al. |
| 6,001,272 | A | 12/1999 | Ikuma et al. |
| 6,028,353 | A | 2/2000 | Nakano et al. |
| 6,189,204 | B1 | 2/2001 | Shikama et al. |
| 6,373,368 | B1 | 4/2002 | Shikama et al. |
| 6,392,525 | B1 | 5/2002 | Kato et al. |
| 6,425,960 | B1 | 7/2002 | Yoshizawa et al. |
| 6,478,889 | B2 | 11/2002 | Kanekiyo et al. |
| 6,710,692 | B2 | 3/2004 | Kato et al. |
| 6,749,767 | B2 | 6/2004 | Mitani et al. |
| 6,750,723 | B2 | 6/2004 | Yoshida et al. |
| 6,791,445 | B2 | 9/2004 | Shibata et al. |
| 6,814,776 | B2 | 11/2004 | Kanekiyo et al. |
| 6,827,557 | B2 | 12/2004 | Kim |
| 6,946,097 | B2 | 9/2005 | Deevi et al. |
| 7,172,660 | B2 | 2/2007 | Song et al. |
| 7,175,716 | B2 | 2/2007 | Tunnicliffe et al. |
| 7,175,717 | B2 | 2/2007 | Song et al. |
| 7,265,651 | B2 | 9/2007 | Brunner |
| 7,532,099 | B2 | 5/2009 | Brunner |
| 2001/0015239 | A1 | 8/2001 | Kanekiyo |
| 2002/0124914 | A1 | 9/2002 | Kim |
| 2002/0158540 | A1 | 10/2002 | Lindquist et al. |
| 2003/0156000 | A1 | 8/2003 | Brunner |
| 2004/0045635 | A1 | 3/2004 | Bandyopadhyay et al. |
| 2004/0079449 | A1 | 4/2004 | Kanekiyo et al. |
| 2004/0089377 | A1 | 5/2004 | Deevi et al. |
| 2004/0183643 | A1 | 9/2004 | Brunner |

(Continued)

FOREIGN PATENT DOCUMENTS

| | | |
|---|---|---|
| DE | 502063 | 7/1930 |

(Continued)

OTHER PUBLICATIONS

Machine translation of JP 2001-196216, No Date.*

Machine Transaltion of Japanese Patent Document No. 2004-063798, No Date.*

Notification of Reasons for Rejection mailed May 6, 2011 for Japanese Patent Application No. 2009-519048 and English Translation of the same.

G.H. Kim et al., "Magnetic properties of FeCuNbSiB nanocrystalline alloy powder cores using ball-milled powder", Journal of Applied Physics, vol. No. 10, Parts 2 and 3, May 15, 2003, pp. 7211-7213.

D. Nuetzel et al., "Nanocrystalline soft magnetic composite-cores with ideal orientation of the powder-flakes", Journal of Magnetism and Magnetic Materials 196-197, (1999), 327-329.

Notification of Reasons for Rejection mailed Jan. 18, 2011 for Japanese Patent Application No. 2009-519048 and English Translation of the same.

E. Wolfarth: "Ferromagnetic Materials vol. 2,"—Soft Magnetic Metallic Materials—p. 73 (1980).

(Continued)

*Primary Examiner* — John Sheehan

(74) *Attorney, Agent, or Firm* — Buchanan Ingersoll & Rooney PC

(57) ABSTRACT

A magnet core is required to be particularly dense, made of alloys produced in a rapid solidification process and have a minimal coercitive field strength. To achieve these aims, a coarse-grain powder fraction is first produced from an amorphous strip of a soft magnetic alloy. In addition, at least one fine-grain powder fraction is produced from a nanocrystalline strip of a soft magnetic alloy. The particle fractions are then mixed to produce a multi-modal powder, wherein the particles of the coarse-grain particle fraction have an amorphous structure and the particles of the fine-grain powder fraction have a nanocrystalline structure. The multi-modal powder is then pressed to produce a magnet core.

38 Claims, No Drawings

U.S. PATENT DOCUMENTS

| | | | |
|---|---|---|---|
| 2005/0028889 | A1 | 2/2005 | Song et al. |
| 2005/0034787 | A1 | 2/2005 | Song et al. |
| 2005/0236071 | A1 | 10/2005 | Koshiba et al. |
| 2007/0193657 | A1 | 8/2007 | Brunner |
| 2008/0001702 | A1 | 1/2008 | Brunner |
| 2009/0206975 | A1 | 8/2009 | Nuetzel et al. |
| 2010/0194507 | A1 | 8/2010 | Brunner |

FOREIGN PATENT DOCUMENTS

| | | | |
|---|---|---|---|
| DE | 694374 | | 7/1940 |
| DE | 1740491 | | 12/1956 |
| DE | 1564643 | | 1/1970 |
| DE | 2816173 | | 10/1979 |
| DE | 3422281 | A1 | 12/1984 |
| DE | 19608891 | A1 | 9/1997 |
| DE | 69810551 | T2 | 3/1999 |
| DE | 19844132 | | 4/1999 |
| DE | 19860691 | A1 | 3/2000 |
| DE | 198 37 630 | C1 | 5/2000 |
| DE | 19908374 | A1 | 9/2000 |
| DE | 199 42 939 | A1 | 3/2001 |
| DE | 100 64 024 | A1 | 6/2001 |
| DE | 10024824 | | 11/2001 |
| DE | 100 31 923 | A1 | 1/2002 |
| DE | 103 48 808 | B4 | 3/2005 |
| DE | 103 48 810 | A1 | 3/2005 |
| DE | 602 05 728 | T2 | 3/2006 |
| DE | 10 2006 008 2 | | 8/2007 |
| EP | 0 216 457 | | 4/1987 |
| EP | 0299498 | | 1/1989 |
| EP | 0 302 355 | A1 | 2/1989 |
| EP | 0455 113 | B1 | 11/1991 |
| EP | 0271657 | | 5/1992 |
| EP | 0 502 397 | A2 | 9/1992 |
| EP | 0 794 538 | A1 | 9/1997 |
| EP | 0824755 | B1 | 2/1998 |
| EP | 0899 753 | B1 | 3/1999 |
| EP | 0 936 638 | A2 | 8/1999 |
| EP | 1 371 434 | B1 | 12/2003 |
| JP | 51092097 | A | 2/1975 |
| JP | 57-039516 | | 3/1982 |
| JP | 57-187357 | | 11/1982 |
| JP | 59177902 | | 10/1984 |
| JP | 59179729 | A | 10/1984 |
| JP | 61058450 | | 3/1986 |
| JP | 61-166902 | | 7/1986 |
| JP | 61-172709 | A | 8/1986 |
| JP | 62-226603 | | 10/1987 |
| JP | 62-232103 | | 10/1987 |
| JP | 63-21807 | | 1/1988 |
| JP | 64-053404 | | 3/1989 |
| JP | 1-139702 | | 6/1989 |
| JP | 02-047812 | | 2/1990 |
| JP | 4-048005 | A | 2/1992 |
| JP | 41-65605 | | 6/1992 |
| JP | 04-213804 | | 8/1992 |
| JP | 05-097907 | | 4/1993 |
| JP | 05-283238 | | 10/1993 |
| JP | 05-299232 | | 11/1993 |
| JP | 53-04018 | | 11/1993 |
| JP | 06-224023 | | 8/1994 |
| JP | 82-55717 | | 10/1996 |
| JP | 83-18542 | A | 12/1996 |
| JP | 9-306715 | | 11/1997 |
| JP | 10-092623 | | 4/1998 |
| JP | 10-097913 | | 4/1998 |
| JP | 10-208923 | | 8/1998 |
| JP | 2000-182845 | | 6/2000 |
| JP | 2000-277357 | A | 10/2000 |
| JP | 2001-068324 | | 3/2001 |
| JP | 2001-196216 | | 7/2001 |
| JP | 2004-063798 | | 7/2002 |
| JP | 2003-534656 | | 11/2003 |
| JP | 2004-179270 | | 6/2004 |
| JP | 2004-349585 | | 12/2004 |
| JP | 2005-150257 | | 6/2005 |
| JP | 2005-171275 | | 6/2005 |
| JP | 2006-118040 | | 5/2006 |
| SU | 338550 | | 5/1972 |
| WO | WO 00/10755 | | 3/2000 |
| WO | WO 00/25326 | | 5/2000 |
| WO | WO 00/28556 | | 5/2000 |
| WO | WO 00/30132 | | 5/2000 |
| WO | WO 01/18828 | A1 | 3/2001 |
| WO | WO 01/91141 | A1 | 11/2001 |
| WO | WO 03/088281 | A1 | 10/2003 |

OTHER PUBLICATIONS

R. McCurrie, "Ferromagnetic Materials Structure and Properties," Academic Press, pp. 77-78 (1994).

J. Wünning: "Die Wärmebehandlung in der Fertigungslinie mit einem neuartigen Rollenherdofen," HTM Härterei—Technische Mitteilungen 45 Nov./Dec. 1990, No. 6, pp. 325-329 XP 163038.

Examination Report dated Sep. 24, 2009 for European Publication No. 02 745 429.7-2208 (English Translation and Certificate of Translation dated Dec. 30, 2010).

Heczko, O. et al., "Magnetic Properties of Compacted Alloy $Fe_{73.5}Cu_7Nb_3Si_{13.5}B_9$ in Amorphous and Nanocrystalline State", IEEE Transaction Magazine, vol. 29, No. 6, 1993, 2670 English Abstract.

Kawamura, Yoshihito et al., "Fabrication of Nanocrystalline $Fe_{86}Zr_7B_6Cu_1$ Soft-Magnetic Compacts with High Saturation Magnetization", J. Applied Physics (ISSN 0021-8979), vol. 76, No. 9, p. 5545-5551, English Abstract, Nov. 1994.

Mazaleyrat et al., "Permeability of Soft Magnetic Composites From Flakes of Nanocrystalline Ribbon," IEEE Transactions of Magnetics, vol. 38, No. 5, Sep. 2002, pp. 3132-3134.

Examination Report dated Feb. 26, 2003 for German Patent Publication No. 101 34 056.7-33 (English Translation and Certificate of Translation dated Nov. 23, 2009).

Notification of Reasons for Refusal dated Jun. 29, 2010 for Japanese Patent Publication No. 2001-587447 and English Translation of the same.

Office Action dated Apr. 22, 2010 for German Patent Application No. 10 2009 038 730.7-24 and English Translation of the same.

Non-Final Office Action dated Jun. 11, 2009 for U.S. Appl. No. 11/663,271.

Non-Final Office Action dated Sep. 22, 2009 for U.S. Appl. No. 11/663,271.

Final Office Action dated Oct. 30, 2009 for U.S. Appl. No. 11/343,558.

Non-Final Office Action dated Apr. 1, 2010 for U.S. Appl. No. 11/343,558.

Final Office Action dated Oct. 15, 2010 for U.S. Appl. No. 11/343,558.

Non-Final Office Action dated Aug. 31, 2010 for U.S. Appl. No. 11/878,856.

Restriction Requirement dated Nov. 4, 2009 for U.S. Appl. No. 11/878,856.

Non-Final Office Action dated Mar. 22, 2010 for U.S. Appl. No. 11/878,856.

Restriction Requirement dated Sep. 22, 2010 for U.S. Appl. No. 12/219,615.

Restriction Requirement dated Apr. 26, 2010 for U.S. Appl. No. 12/486,528.

Non-Final Office Action dated Jul. 27, 2010 for U.S, Appl. No. 12/486,528.

Non-Final Office Action dated Sep. 29, 2008 for U.S. Appl. No. 11/343,558.

Non-Final Office Action dated Apr. 6, 2009 for U.S. Appl. No. 11/343,558.

* cited by examiner

METHOD FOR THE PRODUCTION OF MAGNET CORES, MAGNET CORE AND INDUCTIVE COMPONENT WITH A MAGNET CORE

This application claims benefit of the filing date of DE 10 2006 032 520.6, filed on Jul. 12, 2006, and of U.S. Provisional Application Ser. No. 60/820,222, filed on Jul. 24, 2006.

BACKGROUND

1. Field

Disclosed herein is a method for the production of magnetic powder composite cores pressed from a mix of alloy powder and binder. Also disclosed is a magnet core produced from a mix of alloy powder and binder and an inductive component containing such a magnet core.

2. Description of Related Art

In powder composite cores of this type, low hysteresis and eddy-current losses and low coercitive field strength are desired. The powder is typically supplied in the form of flakes provided by comminuting a soft magnetic strip produced using melt spinning technology. These flakes may, for example, have the form of platelets and are typically first provided with an electrically insulating coating and then pressed to produce a magnet core. While flakes of pure iron or iron/nickel alloys are so ductile that they are plastically deformed under the influence of the compacting pressure and result in pressed cores of high density and strength, flakes or powders of relatively hard and rigid materials cannot be pressed with just any pressure. Rigid flakes would break in unsuitable conditions, resulting not in the desired compaction, but only in a further reduction of particle size. In addition, the break-up of the flakes releases fresh surfaces without any electrically insulating coating, which can lead to a drastic reduction of the resistivity of the magnet core and thus to high eddy-current losses at high frequencies.

As described, for example, in DE 103 48 810 A1, it is possible to use powders with a multi-modal particle size distribution. A multi-modal size distribution permits a relatively dense packing of the particles, and thus permits the production of a relatively dense magnet core.

When using FeAlSi-based materials, the high energy input required for comminution results in structural damage in the production of fine-grain particle fractions, but such damage is healed virtually completely in the subsequent heat treatment process and hardly affects the magnetic properties of the finished magnet core. In mixes with ductile materials, packing density can be increased by increasing the ductile component, for example the pure iron component. This procedure is, for example, described in JP 2001-196216.

SUMMARY

Problems are posed, however, by the production of dense magnet cores from amorphous FeBSi-based materials, which are favoured owing to their good magnetic properties. In the energy-intensive production of the fine-grain particle fractions, FeBSi-based materials form phases of iron borides, which represent permanent structural damage and adversely affect magnetic properties.

Disclosed herein is a method for the production of a powder composite core, which allows the production of particularly dense magnet cores from alloys produced in a rapid solidification process. Also disclosed herein is a particularly dense magnet core with low coercitive field strength.

One embodiment of a method described herein for the production of a magnet core comprises the following steps: First, at least one coarse-grain powder fraction is produced from an amorphous strip of a soft magnetic alloy. In addition, at least one fine-grain powder fraction is produced from a nanocrystalline strip, likewise of a soft magnetic alloy. Following comminution, the particle fractions may be sized in order to obtain an optimum particle size distribution. The particle fractions are then mixed to produce a multi-modal powder, the particles of the coarse-grain particle fraction having an amorphous structure, while the particles of the fine-grain particle fraction have a nanocrystalline structure. The multi-modal powder is then pressed to produce a magnet core.

The soft magnetic strip material is typically produced as amorphous strip in a rapid solidification process, the term "strip" in this context including a foil-like form or pieces of strip. To produce a nanocrystalline strip, the amorphous strip can then be subjected to heat treatment to obtain the nanocrystalline structure.

According to a basic concept of the invention, the aim is to minimise energy input in the comminution of the strip material to produce a powder. Energy input can be reduced by converting the strip into a nanocrystalline state prior to comminution, thus making it very brittle. In this brittle state, the fine-grain powder fractions can be produced without increasing energy input sufficiently for the formation of FeB phases. In this way, irreversible structural damage can be avoided. On the other hand, the production of the coarse-grain powder fraction from nanocrystalline strip is not advisable, because the flakes produced from nanocrystalline strip would also be nano-crystalline and therefore so brittle that they would not be compacted under pressure, but rather would disintegrate.

This problem can be solved by producing the fine-grain and the coarse-grain powder fractions by different means. By separately producing the fine-grain fractions from nanocrystalline strip and the coarse-grain fractions from amorphous strip, the roles played by the powder fractions in the production of the magnet core and their properties in the pressing process are taken into consideration. The production processes for the different powder fractions are "tailor-made" in a manner of speaking. As a result, the properties of the powder can be precisely adapted to pressing conditions and to the desired density of the finished magnet core before the pressing process.

In this way, an alloy capable of nanocrystallisation can be used even for the amorphous strip, provided it is still in a amorphous state at the time of pressing. However, the initially amorphous alloy capable of nanocrystallisation can be converted into a nanocrystalline alloy by heat treatment. As a result, a variety of alloy combinations can be used for the coarse- and fine-grain fractions: The fine-grain fraction is produced from an alloy capable of nanocrystallisation, which is already in a nanocrystalline state in the pressing process. The coarse-grain fraction, on the other hand, can be produced either from an alloy not capable of nanocrystallisation or from an alloy capable of nanocrystallisation, and in the latter case, the alloy can be converted into a nanocrystalline state after pressing.

DETAILED DESCRIPTION OF SPECIFIC EMBODIMENTS

The particles representing the fine-grain powder fraction advantageously have a diameter between 20 and 70 μm, while the particles representing the coarse-grain powder fraction have a diameter between 70 and 200 μm. With particles in this size range, relatively dense packing and, therefore, dense magnet cores can be obtained.

In one embodiment of the method, the amorphous strip is pre-embrittled by heat treatment at a pre-embrittling temperature $T_{embrittle}$ prior to the production of the coarse-grain powder fraction in order to simplify comminution, the pre-embrittling temperature $T_{embrittle}$ and the crystallisation temperature $T_{crystal}$ of the amorphous strip having the relationship $T_{embrittle}<T_{crystal}$. The pre-embrittling temperature $T_{embrittle}$ is therefore chosen so that it is low enough to avoid (nano-) crystallisation. It is further chosen to be low enough, and the duration of the heat treatment is chosen to be short enough, to make the particles produced from the strip ductile enough to avoid break-up in the pressing process. The pre-embrittling temperature $T_{embrittle}$ advantageously is 100° C.$\leqq T_{embrittle} \leqq$400° C., preferably 200° C.$\leqq T_{embrittle} \leqq$400° C. The duration of the heat treatment may be 0.5 to 8 hours.

In an alternative embodiment of the method, the amorphous strip is comminuted to produce the coarse-grain powder fraction without any preceding heat treatment for pre-embrittling in the "as cast" state, i.e. in the state in which it is following the rapid solidification process. The amorphous strip is advantageously comminuted to produce the coarse-grain powder fraction at a grinding temperature $T_{mill}$ of −196° C.$\leqq T_{mill} \leqq$20° C.

The nanocrystalline strip used to produce the fine-grain powder fraction is, for example, comminuted in a cutting mill. Using a cutting mill instead of, for example, a ball mill reduces energy input to a minimum and avoids irreversible structural damage.

In one embodiment of the method, the same alloy is used for the amorphous strip and for the nanocrystalline strip. In this case, the strip used to produce the fine-grain powder fraction is nanocrystallised by heat treatment following the rapid solidification process, while the strip used to produce the coarse-grain powder fraction is left in its amorphous state.

It is, however, alternatively possible to use different alloys. The first soft magnetic alloy for the amorphous strip may, for instance, be an alloy which is particularly suitable for processing in the amorphous state and which is sufficiently ductile, while the second soft magnetic alloy for the nanocrystalline strip may be an alloy which can be nanocrystallised particularly easily.

In view of these considerations, suitable soft magnetic alloys for both the amorphous and the nanocrystalline strip are soft magnetic iron-based alloys.

In one embodiment, the amorphous particles have the alloy composition $M_\alpha Y_\beta Z_\gamma$, wherein M is at least one element from the group including Fe, Ni and Co, wherein Y is at least one element from the group including B, C and P, wherein Z is at least one element from the group including Si, Al and Ge, and wherein α, β and γ are specified in atomic percent and meet the following conditions: $70 \leqq \alpha \leqq 85$; $5 \leqq \beta \leqq 20$; $0 \leqq \gamma \leqq 20$, wherein up to 10 atomic percent of the M component may be replaced by at least one element from the group including Ti, V, Cr, Mn, Cu, Zr, Nb, Mo, Ta and W and up to 10 atomic percent of the (Y+Z) component may be replaced by at least one element from the group including In, Sn, Sb and Pb.

The particles capable of nanocrystallisation may have the alloy composition $(Fe_{1-a}M_a)_{100-x-y-z-\alpha-\beta-\gamma} Cu_x Si_y B_z M'_\alpha M''_\beta X_\gamma$, wherein M is Co and/or Ni, wherein M' is at least one element from the group including Nb, W, Ta, Zr, Hf, Ti and Mo, wherein M" is at least one element from the group including V, Cr, Mn, Al, elements of the platinum group, Sc, Y, rare earths, Au, Zn, Sn and Re, wherein X is at least one element from the group including C, Ge, P, Ga, Sb, In, Be and As, and wherein a, x, y, z, α, β and γ are specified in atomic percent and meet the following conditions: $0 \leqq a \leqq 0.5$; $0.1 \leqq x \leqq 3$; $0 \leqq y \leqq 30$; $0 \leqq z \leqq 25$; $0 \leqq y+z$ 35; $0.1 \leqq \alpha \leqq 30$; $0 \leqq \beta \leqq 10$; $0 \leqq \gamma \leqq 10$.

As an alternative, the particles capable of nanocrystallisation may have the alloy composition $(Fe_{1-a-b}Co_a Ni_b)_{100-x-y-z} M_x B_y T_z$, wherein M is at least one element from the group including Nb, Ta, Zr, Hf, Ti, V and Mo, wherein T is at least one element from the group including Cr, W, Ru, Rh, Pd, Os, Ir, Pt, Al, Si, Ge, C and P, and wherein a, b, x, y and z are specified in atomic percent and meet the following conditions: $0 \leqq a \leqq 0.29$; $0 \leqq b \leqq 0.43$; $4 \leqq x \leqq 10$; $3 \leqq y \leqq 15$; $0 \leqq z \leqq 5$.

For the strip capable of nanocrystallisation, one or more of the alloys $Fe_{73.5}Nb_3Cu_1Si_{15.5}B_7$, $Fe_{73.5}Nb_3Cu_1Si_{13.5}B_9$, $Fe_{86}Cu_1Zr_7B_6$, $Fe_{91}Zr_7B_3$ and $Fe_{84}Nb_7B_9$ can be used.

The multi-modal powder obtained by mixing coarse- and fine-grain powder fractions is advantageously pressed at a pressing temperature $T_{press}$ of $T_{press}>T_{embrittle}$ to produce a magnet core. This ensures that the coarse-grain particles, in particular, behave in a very ductile manner and that there is no further mechanical comminution during the pressing process.

After pressing, the magnet core is advantageously subjected to heat treatment at a heat treatment temperature $T_{anneal}$ in order to relieve mechanical stresses introduced into the magnet core by pressing and to obtain good magnetic properties, in particular a low coercitive field strength. The heat treatment temperature $T_{anneal}$ is expediently chosen such that the heat treatment temperature $T_{anneal}$ and the crystallisation temperature $T_{crystal}$ of the first soft magnetic alloy have the relationship $T_{anneal}$ $T_{crystal}$. This results in the nanocrystallisation of the coarse-grain particles which still have an amorphous structure at this point. For this purpose, the heat treatment temperature is typically set above 500° C.

As an alternative, the heat treatment temperature $T_{anneal}$ may be chosen such that the heat treatment temperature $T_{anneal}$ and the crystallisation temperature $T_{crystal}$ of the first soft magnetic alloy have the relationship $T_{anneal} \leqq T_{crystal}$. In this case, the nano-crystallisation of the amorphous particle fraction is avoided. The only purpose of the heat treatment in this case is the relief of mechanical stresses, and typically 400° C. $T_{anneal} \leqq$450° C.

All heat treatment processes are advantageously conducted in a controlled atmosphere to prevent corrosion and thus the premature ageing of the magnet core combined with a deterioration of its magnetic properties.

Prior to pressing, in certain embodiments, processing aids such as binders and/or lubricants are advantageously added to the multi-modal powder. In other embodiments, particles representing the coarse- and/or fine-grain powder fractions may be pickled in an aqueous or alcohol solution prior to pressing to apply an electrically insulating coating and then dried. An electrically insulating coating may also be applied by different means. It is used to reduce the resistivity of the magnet core and to reduce eddy-current losses.

A magnet core described herein comprises a soft magnetic powder made from particles, the particle size distribution being multi-modal. It can further comprise processing aids such as binders. In certain embodiments, the powder comprises at least one coarse-grain powder fraction with particles with an amorphous structure and at least one fine-grain powder fraction with particles with a nanocrystalline structure.

A magnet core of this type may combine an exceptionally high density with a low coercitive field strength, because the multi-modal particle size distribution permits a particularly dense packing of the particles, while the particle surfaces suffer only minor deformation and structural damage.

The magnet core according to the invention can be used in inductive components such as storage chokes, PFC chokes (chokes for power factor correction), switching power supplies, filter chokes or smoothing chokes.

Specific embodiments are described in greater detail below in order to further illustrate and exemplify the method and magnet core disclosed herein, without limiting the scope of the appended claims.

EXAMPLE 1

From a strip with the nominal composition $Fe_{73.5}Nb_3Cu_1Si_{15.5}B_7$, particle fractions with the following particle diameters were produced: The nanocrystalline particles of the first fraction had diameters between 28 and 50 μm, the amorphous particles of the second fraction had diameters between 80 and 106 μm, and the likewise amorphous particles of the third fraction had diameters between 106 and 160 μm. The press-ready powder mix consisted of 29% flakes of the first fraction, 58% flakes of the second fraction and 10% flakes of the third fraction in addition to 2.8% binder mix and 0.2% lubricant. The mix was pressed at a pressure of 8 t/cm$^2$ and a temperature of 180° C. to produce a magnet core. After pressing, the core had a density of 67 percent by volume. After pressing, the magnet core was subjected to a heat treatment lasting one hour in a controlled atmosphere at 560° C. The finished magnet core had a static coercitive field strength of 51.6 A/m.

EXAMPLE 2

From a strip with the nominal composition $Fe_{73.5}Nb_3Cu_1Si_{15.5}B_7$, particle fractions with the following particle diameters were produced: The nanocrystalline particles of the first fraction had diameters between 40 and 63 μm, and the amorphous particles of the second fraction had diameters between 80 and 106 μm. The press-ready powder mix consisted of 48.5% flakes of the first fraction, 48.5% flakes of the second fraction and 2.8% binder mix and 0.2% lubricant. The mix was pressed at a pressure of 8 t/cm$^2$ and a temperature of 180° C. to produce a magnet core. After pressing, the core had a density of 68.3 percent by volume. After pressing, the magnet core was subjected to a heat treatment lasting one hour in a controlled atmosphere at 560° C. The finished magnet core had a static coercitive field strength of 55.4 A/m.

For comparison, magnet cores were produced in the conventional way from purely amorphous powders.

Comparative Example 1

From a strip with the nominal composition $Fe_{73.5}Nb_3Cu_1Si_{15.5}B_7$, purely amorphous particles with particle diameters between 80 and 106 μm were produced. The press-ready powder mix consisted of 97% of these amorphous particles and 2.8% binder mix and 0.2% lubricant. The mix was pressed at a pressure of 8 t/cm$^2$ and a temperature of 180° C. to produce a magnet core. After pressing, the core had a density of 61.7 percent by volume. After pressing, the magnet core was subjected to a heat treatment lasting one hour in a controlled atmosphere at 560° C. The finished magnet core had a static coercitive field strength of 71.0 A/m.

Comparative Example 2

From a strip with the nominal composition $Fe_{73.5}Nb_3Cu_1Si_{15.5}B_7$, purely amorphous particle fractions with the following particle diameters were produced: The particles of the first fraction had diameters between 40 and 63 μm, and the particles of the second fraction had diameters between 80 and 106 μm. The press-ready powder mix consisted of 48.5% flakes of the first fraction, 48.5% flakes of the second fraction and 2.8% binder mix and 0.2% lubricant. The mix was pressed at a pressure of 8 t/cm$^2$ and a temperature of 180° C. to produce a magnet core. After pressing, the core had a density of 63.2 percent by volume. After pressing, the magnet core was subjected to a heat treatment lasting one hour in a controlled atmosphere at 560° C. The finished magnet core had a static coercitive field strength of 100.5 A/m.

These examples show that high densities can be combined with low coercitive field strengths of the magnet cores when using the method described herein. The low coercitive field strength in the magnet cores from examples 1 and 2 is due to the fact that the fine-grain particles, as a result of their production from a nanocrystalline material, do not suffer any significant irreversible structural damage caused by the formation of FeB phases.

As a result of the separate production of coarse-grain amorphous and fine-grain nano-crystalline powder fractions, the resulting powder mix meets all requirements: It is multi-modal and allows, even when using FeBSi-based alloys capable of nano-crystallisation, a very dense packing of the particles, resulting in a high density of the magnet core. Owing to their amorphous structure, the coarse-grain particles are ductile enough not to break up in the pressing process. And finally, being produced from a nanocrystalline starting material, the fine-grain particles are not irreversibly damaged by the formation of iron boride phases which would adversely affect the magnetic properties of the core.

The examples and embodiments described herein are provided to illustrate, rather than limit the scope of, the appended claims.

The invention claimed is:

1. A method for the production of a magnet core, comprising:

producing from an amorphous soft magnetic strip at least one coarse-grain powder fraction having particle diameters between 70 and 200 μm;

producing from a nanocrystalline soft magnetic strip made of an alloy capable of nanocrystallisation at least one fine-grain powder fraction having particle diameters between 20 and 63 μm;

mixing of the coarse- and fine-grain powder fractions to produce a powder mixture with a multi-modal particle size distribution, wherein the particles of the coarse-grain particle fraction have an amorphous structure and the particles of the fine-grain powder fraction have a nanocrystalline structure;

pressing of the multi-modal powder mixture to produce a magnet core.

2. The method according to claim 1, further comprising pre-embrittling the amorphous strip by heat treating at a pre-embrittling temperature $T_{embrittle}$ prior to the production of the coarse-grain powder fraction, wherein the pre-embrittling temperature $T_{embrittle}$ is related to a crystallisation temperature $T_{crystal}$ of the amorphous strip by the relationship $T_{embrittle}<T_{crystal}$.

3. The method according to claim 2 wherein 100° C.$\leqq T_{embrittle} \leqq$400° C.

4. The method according to claim 3 wherein 200° C.$\leqq T_{embrittle}$ 400° C.

5. The method according to claim 1 wherein the producing of the coarse-grain powder fraction comprises comminuting the amorphous strip in an as-cast state without any preceding heat treatment for pre-embrittling.

6. The method according to claim 1
wherein the producing of the coarse-grain powder fraction comprises comminuting the amorphous strip at a grinding temperature $T_{mill}$ of −196° C.≦$T_{mill}$≦20° C.

7. The method according to claim 1
wherein the producing of the fine-grain fraction comprises comminuting the nanocrystalline strip in a cutting mill.

8. The method according to claim 1
wherein the amorphous strip comprises an alloy not capable of nanocrystallisation.

9. The method according to claim 8,
wherein the amorphous strip comprises an iron-based.

10. The method according to claim 8,
wherein the amorphous strip comprises an alloy of the composition $M_\alpha Y_\beta Z_\gamma$,
wherein M is at least one element from the group consisting of Fe, Ni and Co,
wherein Y is at least one element from the group consisting of B, C and P,
wherein Z is at least one element from the group consisting of Si, Al and Ge, and
wherein α, β and γ are specified in atomic percent and meet the following conditions:
70≦α≦85;
5≦β≦20; and
0≦γ≦20,
wherein up to 10 atomic percent of the M component may be replaced by at least one element from the group consisting of Ti, V, Cr, Mn, Cu, Zr, Nb, Mo, Ta and W, and
and wherein up to 10 atomic percent of the (Y+Z) component may be replaced by at least one element from the group including In, Sn, Sb and Pb.

11. The method according to claim 1, wherein
the amorphous strip and the nanocrystalline strip comprise the same alloy, and wherein the alloy is capable of nanocrystallisation.

12. The method according to claim 1, wherein
the amorphous strip and the nanocrystalline strip comprise different alloys, and wherein both alloys are capable of nanocrystallisation.

13. The method according to claim 1, wherein
at least one of the amorphous strip and the nanocrystalline strip comprise an alloy capable of nanocrystallisation and that has the composition $(Fe_{1-a}M_a)_{100-x-y-z-\alpha-\beta-\gamma}Cu_xSi_yB_zM'_\alpha M''_\beta X_\gamma$,
wherein M is Co and/or Ni,
wherein M' is at least one element from the group consisting of Nb, W, Ta, Zr, Hf, Ti and Mo,
wherein M" is at least one element from the group consisting of V, Cr, Mn, Al, elements of the platinum group, Sc, Y, rare earths, Au, Zn, Sn and Re,
wherein X is at least one element from the group consisting of C, Ge, P, Ga, Sb, In, Be and As, and
wherein a, x, y, z, α, β and γ are specified in atomic percent and meet the following conditions:
0≦a≦0.5;
0.1≦x≦3;
0≦y≦30;
0≦z≦25;
0≦y+z≦35;
0.1≦α≦30;
0≦β≦10; and
0≦γ≦10.

14. The method according to claim 1, wherein
at least one of the amorphous strip and the nanocrystalline strip comprise an alloy capable of nanocrystallisation and that has the composition $(Fe_{1-a-b}Co_aNi_b)_{100-x-y-z}M_xB_yT_z$,
wherein M is at least one element from the group consisting of Nb, Ta, Zr, Hf, Ti, V and Mo,
wherein T is at least one element from the group consisting of Cr, W, Ru, Rh, Pd, Os, Ir, Pt, Al, Si, Ge, C and P, and
wherein a, b, x, y and z are specified in atomic percent and meet the following conditions:
0≦a≦0.29;
0≦b≦0.43;
4≦x≦10;
3≦y≦15; and
0≦z≦5.

15. The method according to claim 1, wherein
at least one of the amorphous strip and the nanocrystalline strip comprises an alloy capable of nanocrystallisation and that has the composition $Fe_{73.5}Nb_3Cu_1Si_{15.5}B_7$, $Fe_{73.5}Nb_3Cu_1Si_{13.5}B_9$, $Fe_{86}Cu_1Zr_7B_6$, $Fe_{91}Zr_7B_3$ or $Fe_{84}Nb_7B_9$.

16. The method according to claim 1,
wherein
the pressing of the multi-modal powder mixture is conducted at a pressing temperature $T_{press}$ such that $T_{press}>T_{embrittle}$ to produce a magnet core.

17. The method according to claim 1,
further comprising subjecting the magnet core to heat treatment at a heat treatment temperature $T_{anneal}$ after pressing.

18. The method according to claim 17,
wherein the heat treatment temperature $T_{anneal}$ and a crystallisation temperature $T_{crystal}$ of a soft magnetic alloy of the amorphous strip have the relationship $T_{anneal}≧T_{crystal}$.

19. The method according to claim 17,
wherein $T_{anneal}>500°$ C.

20. The method according to claim 17,
wherein the heat treatment temperature $T_{anneal}$ and a crystallisation temperature $T_{crystal}$ of a soft magnetic alloy of the amorphous strip have the relationship $T_{anneal}≦T_{crystal}$.

21. The method according to claim 20,
wherein 400° C.≦$T_{anneal}$≦450° C.

22. The method according to claim 1,
further comprising adding one or more processing aids comprising binders, lubricants, or combinations thereof to the multi-modal powder mixture prior to pressing.

23. The method according to claim 2,
wherein the heat treating is conducted in a controlled atmosphere.

24. The method according to claim 1,
wherein the coarse-grain powder fraction, the fine-grain powder fraction, or a combination thereof, comprises particles that have been pickled in an aqueous or alcohol solution and dried prior to pressing, and wherein the particles thereby have an electrically insulating coating thereon.

25. A magnet core comprising:
soft magnetic particles with a multi-modal particle size distribution and comprising at least one coarse-grain powder fraction of particles with an amorphous structure and having particle diameters between 70 and 200 μm and at least one fine-grain powder fraction of particles with a nanocrystalline structure and having particle diameters between 20 and 63 μm; and
one or more processing aids.

26. The magnet core according to claim 25, wherein the particles with an amorphous structure and the particles with a nanocrystalline structure have the same alloy composition, and wherein the alloy composition is capable of nanocrystallisation.

27. The magnet core according to claim 25, wherein the particles with an amorphous structure and the particles with a nanocrystalline structure have different alloy compositions, and wherein these alloy compositions are capable of nanocrystallisation.

28. The magnet core according to claim 25, wherein the particles with an amorphous structure contains particles of an amorphous iron-based alloy.

29. The magnet core according to claim 25, wherein the particles with an amorphous structure have the alloy composition $M_\alpha Y_\beta Z_\gamma$, wherein M is at least one element from the group including Fe, Ni and Co, wherein Y is at least one element from the group including B, C and P, wherein Z is at least one element from the group including Si, Al and Ge, and wherein α, β and γ are specified in atomic percent and meet the following conditions:

$70 \leqq \alpha \leqq 85$;

$5 \leqq \beta \leqq 20$;

$0 \leqq \gamma \leqq 20$, and wherein up to 10 atomic percent of the M component may be replaced by at least one element from the group including Ti, V, Cr, Mn, Cu, Zr, Nb, Mo, Ta and W, and wherein up to 10 atomic percent of the (Y+Z) component may be replaced by at least one element from the group including In, Sn, Sb and Pb.

30. The magnet core according to claim 25, wherein the particles with a nanocrystalline structure have the alloy composition $(Fe_{1-a}M_a)_{100-x-y-z-\alpha-\beta-\gamma} Cu_x Si_y B_z M'_\alpha M''_\beta X_\gamma$, wherein M is Co and/or Ni, wherein M' is at least one element from the group including Nb, W, Ta, Zr, Hf, Ti and Mo, wherein M' is at least one element from the group including V, Cr, Mn, Al, elements of the platinum group, Sc, Y, rare earths, Au, Zn, Sn and Re, wherein X is at least one element from the group including C, Ge, P, Ga, Sb, In, Be and As, and wherein a, x, y, z, α, β and γ are specified in atomic percent and meet the following conditions:

$0 \leqq a \leqq 0.5$;

$0.1 \leqq x \leqq 3$;

$0 \leqq y \leqq 30$;

$0 \leqq z \leqq 25$;

$0 \leqq y+z \leqq 35$;

$0.1 \leqq \alpha \leqq 30$;

$0 \leqq \beta \leqq 10$; and $0 \leqq \gamma \leqq 10$.

31. The magnet core according to claim 25, wherein the particles with a nanocrystalline structure have the alloy composition $(Fe_{1-a-b}Co_a Ni_b)_{100-x-y-z} M_x B_y T_z$, wherein M is at least one element from the group including Nb, Ta, Zr, Hf, Ti, V and Mo, wherein T is at least one element from the group including Cr, W, Ru, Rh, Pd, Os, Ir, Pt, Al, Si, Ge, C and P, and wherein a, b, x, y and z are specified in atomic percent and meet the following conditions:

$0 \leqq a \leqq 0.29$;

$0 \leqq b \leqq 0.43$;

$4 \leqq x \leqq 10$;

$3 \leqq y \leqq 15$; and $0 \leqq z \leqq 5$.

32. The magnet core according to claim 25, wherein the particles with a nanocrystalline structure have at least one of the alloy compositions $Fe_{73.5}Nb_3Cu_1Si_{15.5}B_7$, $Fe_{73.5}Nb_3Cu_1Si_{13.5}B_9$, $Fe_{86}Cu_1Zr_7B_6$, $Fe_{91}Zr_7B_3$ or $Fe_{84}Nb_7B_9$.

33. The magnet core according to claim 25, wherein the one or more processing aids include one or more binders or lubricants or both.

34. An inductive component comprising a magnet core according to claim 25.

35. The inductive component according to claim 34, wherein the inductive component is a choke for power factor correction.

36. The inductive component according to claim 34, wherein the inductive component is a storage choke.

37. The inductive component according to claim 34, wherein the inductive component is a filter choke.

38. The inductive component according to claim 34, wherein the inductive component is a smoothing choke.

* * * * *

UNITED STATES PATENT AND TRADEMARK OFFICE

CERTIFICATE OF CORRECTION

PATENT NO. : 8,287,664 B2
APPLICATION NO. : 12/308753
DATED : October 16, 2012
INVENTOR(S) : Markus Brunner It is certified that error appears in the above-identified patent and that said Letters Patent is hereby corrected as shown below:

In the Specification

Column 4, line 40 delete "400°C Tanneal≦450°C" and replace therewith --400°C≦Tanneal≦450°C--.

In the Claims

Column 6, line 62 (Claim 4, line 2) delete "200°C≦Tembrittle400°C" and replace therewith --200°C≦Tembrittle≦400°C--.

Column 9, line 41 (Claim 30, line 8) delete "wherein M'" and replace therewith --wherein M″--.

Signed and Sealed this
Eleventh Day of March, 2014

Michelle K. Lee

Michelle K. Lee
*Deputy Director of the United States Patent and Trademark Office*